US005914142A

United States Patent [19]

Zartner

[11] Patent Number: 5,914,142

[45] Date of Patent: Jun. 22, 1999

[54] EASY OPENING BOIL-IN-A-BAG POUCH

[75] Inventor: Rainer R. Zartner, Cluvenhagen, Germany

[73] Assignee: Kraft Jacobs Suchard AG, Zurich, Switzerland

[21] Appl. No.: 08/832,591

[22] Filed: Apr. 2, 1997

Related U.S. Application Data

[60] Provisional application No. 60/016,270, Apr. 23, 1996.

[51] Int. Cl.[6] ..... B65D 33/08; B65D 65/28

[52] U.S. Cl. ..... 426/113; 383/10; 383/209; 426/122; 426/412

[58] Field of Search ..... 383/207–209, 383/200, 107, 108, 10; 426/122, 123, 113, 412

[56] References Cited

U.S. PATENT DOCUMENTS

| | | | |
|---|---|---|---|
| 2,103,389 | 12/1937 | Salfisberg | 383/209 |
| 2,245,738 | 6/1941 | Taylor | 383/209 |
| 2,329,360 | 9/1943 | Salfisberg | 426/122 |
| 2,791,324 | 5/1957 | Knoop et al. | 426/122 |
| 2,811,280 | 10/1957 | Commisso et al. | 383/209 |
| 2,923,404 | 2/1960 | Adell | 383/200 |
| 3,008,837 | 11/1961 | Kaplan | 383/200 |
| 3,072,248 | 1/1963 | Bishop | 426/122 |
| 3,081,174 | 3/1963 | Gay . | |
| 3,114,643 | 12/1963 | Boston et al. | 426/122 |
| 3,162,539 | 12/1964 | Repko | 383/209 |
| 3,388,836 | 6/1968 | Otto et al. | 383/209 |
| 3,615,712 | 10/1971 | Keller . | |
| 3,625,351 | 12/1971 | Eisenberg | 383/207 |
| 4,105,116 | 8/1978 | Jones et al. | 383/209 |
| 4,777,054 | 10/1988 | Greenhouse | 383/209 |
| 5,445,454 | 8/1995 | Barkhorn | 383/207 |
| 5,593,229 | 1/1997 | Warr | 383/209 |
| 5,611,626 | 3/1997 | Warr | 383/209 |
| 5,613,779 | 3/1997 | Niwa | 383/209 |

FOREIGN PATENT DOCUMENTS

| | | | |
|---|---|---|---|
| 561654 | 9/1993 | European Pat. Off. | 383/200 |
| 596747 | 5/1994 | European Pat. Off. | 383/208 |
| 1013665 | 12/1965 | United Kingdom | 426/113 |
| 2093799 | 9/1982 | United Kingdom | 383/209 |

*Primary Examiner*—Steven Weinstein
*Attorney, Agent, or Firm*—Thomas R. Savoie; Thomas A. Marcoux

[57] ABSTRACT

A boil-in-a-bag pouch provided with a handle for grasping and lifting the pouch and including a easy opening mechanism The opening of the pouch is facilitated by a longitudinal line of weakness spaced a short distance from one longitudinal edge of the pouch in combination with either a lateral cut from the edge of the pouch to the line of weakness or one or more interruptions in the lateral seals used to form and seal the pouch through which the line of weakness passes. The interruptions in the lateral seal are small enough to prevent egress of the product from the pouch and are located so as to permit the pouch to be torn open along the line of weakness through the interruptions in the lateral seals. In this manner, a pouch is provided that has both a handle and an easy opening feature.

7 Claims, 5 Drawing Sheets

EASY OPENING BOIL-IN-A-BAG POUCH

This application claims the benefit of U.S. Provisional Application No. 60/016,270 filed Apr. 23, 1996.

BACKGROUND OF THE INVENTION

1. Field of the Invention

The present invention relates to improvements in boil-in-a-bag pouches. More particularly, the present invention relates to a boil-in-a-bag pouch which is provided with a handle and an opening means which facilitates opening the pouch to dispense the foodstuff contained therein.

2. Description of the Prior Art

Boil-in-a-bag pouches have become increasingly popular in recent years. Such pouches are used extensively for packaging rice, pasta or the like. This method of packaging is very convenient for the consumer who merely has to place the entire pouch into boiling water for a specified time period, remove the pouch from the water and dispense the contents for serving These cooking pouches are generally made from plastic materials which are acceptable as foodstuff packaging and are capable of withstanding immersion in boiling water, as well as having sufficient strength to withstand filling, shipping and storage. Such pouches must also typically be transparent, heat sealable and inexpensive.

Such cooking pouches also typically contain a plurality of small perforations over a substantial portion of the surface of the pouch. These perforations allow water to enter and leave the pouch when the pouch is immersed in boiling water during cooking. At the same time, these perforations must be sufficiently small to prevent the egress of foodstuff from the pouch.

One example of such a cooking pouch is described in U.S. Pat. No. 3,081,174. This package is formed from two perforated sheets heat sealed together. The bag includes an open top surrounded by a hem which is provided with a drawstring to close the top of the bag.

Another example of such a cooking pouch is described in U.S. Pat. No. 3,615,712. This package is formed from a perforated sheet heat-sealed to an imperforate sheet to form a pouch. The imperforate side of the pouch is made from a heat shrinkable material and is provided with a line of weakness for opening the pouch to dispense and serve the foodstuff contained therein.

A more recent example of a commercially available boil-in-a-bag pouch is shown in FIG. 5 of the present application. This pouch is formed from a single sheet of perforated plastic film heat-sealed along its edges to form a pouch. Such pouches also include a handle used to grasp and lift the pouch out of boiling water once cooking of the foodstuff is complete. The handle is formed by making a third lateral seal a short distance below the seal along the top edge of the pouch and making a short, lateral cut between the top seal and the third lateral seal through both layers of the pouch. The third lateral seal prevents egress of foodstuff through the cut which forms the handle This version of the boil-in-a-bag pouch can be grasped by inserting a finger, fork or other implement through the hole created by the lateral cut.

Consumers have found that the provision of a handle on boil-in-a-bag pouches further increases the convenience of preparing foods using such pouches However, such pouches suffer from the disadvantage that they are difficult to open since in order to tear such pouches open, a tear must be made through at least one and perhaps all three of the lateral seals. Such seals tend to resist tearing and thus render opening of the pouch difficult.

Accordingly, there is a need in the art for a boil-in-a-bag pouch which includes a convenient handle while at the same time is easy to open for dispensing of the foodstuff from the package.

SUMMARY OF THE INVENTION

In a first aspect, the present invention relates to a foodstuff pouch which comprises two overlapping layers of plastic film sealed together by at least three seals to form the pouch. At least two of the seals are located along the top and bottom edges of the plastic film to form the top and bottom of the pouch. The plastic film also contains a plurality of perforations disposed over a substantial portion of the surface of the film. The perforations are sufficiently large and numerous to permit water to freely enter and leave the pouch when the pouch, with a foodstuff contained therein, is immersed in water, and the perforations are also sufficiently small to prevent egress of the foodstuff from the pouch.

The pouch also includes a handle formed from a combination of a lateral seal between the overlapping layers of film, said lateral seal being located parallel to and spaced-apart from the top seal, and a lateral cut located between the top seal and the lateral seal. The lateral cut that forms the handle has ends which are spaced from the side edges of the pouch and the lateral cut penetrates both layers of the film to provide a way of grasping and lifting the pouch. Lastly, the pouch includes an opening means formed by a line of weakness which runs substantially the entire length from the top to the bottom of the pouch and which is located between one end of the lateral cut which forms the handle and the side edge of the pouch.

In a more preferred embodiment, the opening means of the pouch includes an interruption in the lateral seal which is placed such that the line of weakness passes through the interruption in the seal. In another embodiment, the bottom seal also includes an interruption which is aligned with the interruption in the lateral seal such that the line of weakness passes through both interruptions in the bottom and lateral seals.

In still another embodiment, the opening means of the pouch also includes a second lateral cut located between the lateral and top seals and extending from one side edge of the pouch to the line of weakness.

The present invention solves the problem of providing a convenient handle for grasping and lifting a boil-in-a-bag pouch from boiling water, while at the same time providing a pouch which is easy to open in order to dispense the foodstuff from the pouch.

These and other objects of the present invention will be apparent from the detailed description of the invention which follows.

DETAILED DESCRIPTION OF THE PREFERRED EMBODIMENTS

The invention will now be described in detail with reference to the figures. Like elements are indicated by like numerals throughout the several views.

Figure 1:
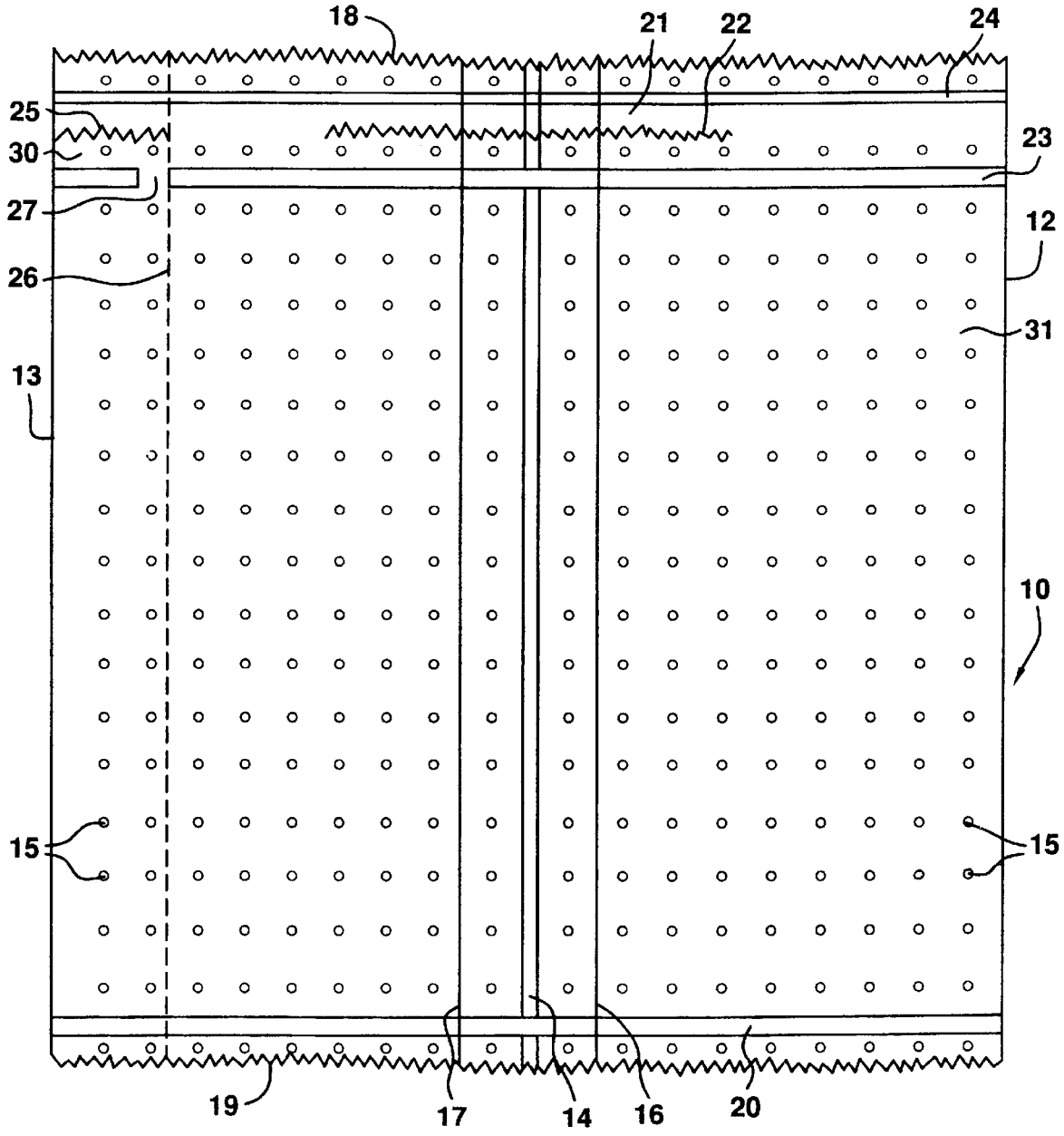
FIG. 1 is a plan view of a first embodiment of the boil-in-a-bag pouch of the present invention.

Shown in FIG. 1 is a first embodiment of a boil-in-bag pouch 10 formed from a single sheet of plastic film which is folded at folds 12, 13 and sealed together by a longitudinal seal 14. The plastic film is perforated by a plurality of small openings 15 which are arranged in a pattern that preferably extends over at least a substantial portion of the plastic film and most preferably covers the entire surface of the film. Openings 15 are provided in the film in order to allow water to enter the boil-in-bag pouch 10 during cooking Openings 15 should be sufficiently large to permit passage of water into and out of pouch 10 but should be small enough to prevent product from leaking out of pouch 10 through openings 15 during transport, storage and cooking.

Pouch 10 may also be fabricated from two sheets of plastic film laid coextensively over one another and sealed along all four edges of the film in order to form the pouch. However, this method is less preferred since it requires a more difficult and/or costly manufacturing procedure.

The plastic film may be made from a transparent and/or semi-transparent film material such as a medium density polyethylene or the like. The plastic film should be sufficiently heat resistant that it can be placed in boiling water for an extended period of time without losing its structural integrity The piece of plastic film used to form pouch 10 is preferably cut to the desired size from a continuous roll of film by a conventional cutting apparatus. The preferred cutting apparatus is of the type which makes a tooth gear cut. As a result, the top and bottom of pouch 10 will generally exhibit tooth gear cut patterns 18, 19 as shown in FIG. 1. Other suitable cutting means known to those of skill in the art may also be employed in order to cut the desired length of plastic film to form pouch 10.

Any suitable method and apparatus may be used to form and fill pouch 10 Pouch 10 is preferably formed and filled using a conventional vertical, form-fill-seal machine.

The film is folded such that one longitudinal edge 16 overlaps the other longitudinal edge 17 of plastic film. A longitudinal seal 14 is then applied in the overlapping area in order to affix longitudinal edges 16, 17 to each other and form a continuous tube, which upon filling and sealing forms folds 12, 13, a back layer 31 and a front layer 32 (shown in FIG. 4) which together form the pouch 10.

The next step in forming pouch 10 is to provide a lateral bottom seal 20 between the two layers of plastic film across the bottom edge of the film in order to form pouch 10. Once lateral bottom seal 20 is in place, pouch 10 can be filled with product since lateral bottom seal 20 coupled with longitudinal seal 14 form the plastic film into a pouch 10 which is capable of holding product.

At this stage, pouch 10 may be filled with the product that is to be housed and cooked in pouch 10. Such products may include rice 33 (shown in FIG. 4), frozen vegetables or any other foodstuffs which lend themselves to cooking by boil-in-a-bag methods.

Once pouch 10 is filled with a desired product, lateral middle seal 23 and lateral top seal 24 are formed between the two layers 31, 32 of plastic film The purpose of lateral middle seal 23 is to prevent the product from leaking out of pouch 10. Lateral top seal 24 provides structural integrity to the top of pouch 10 such that a handle means 21 can be formed in the pouch 10 above lateral middle seal 23.

A handle means 21 is provided in pouch 10 by making an additional lateral tooth gear cut 22 which penetrates both layers 31, 32 of pouch 10. Lateral tooth gear cut 22 permits lifting of the pouch 10 by insertion of a finger, fork or other implement through the handle means 21 formed by lateral tooth gear cut 22. Lateral tooth gear cut 22 can also be any other type of cut formed by a conventional cutting apparatus known to those of ordinary skill in the art.

Pouch 10 also includes an easy opening means. The opening means of this embodiment is formed by a second lateral tooth gear cut 25 in combination with a line of weakness formed by a longitudinal perforation 26 located a short distance from fold 13 which forms the side edge of pouch 10 and which passes through an interrupted sealing area 27 in lateral middle seal 23. Lateral tooth gear cut 25 and longitudinal perforation 26 penetrate both layers 31, 32 of plastic film which form pouch 10. Longitudinal perforation 26 may be formed by any suitable means known to those skilled in the art. Interrupted sealing area 27 may also be formed by conventional means such as by interrupting the sealing operation for a short distance during the formation of lateral middle seal 23. Interrupted sealing area 27 should be sufficiently small to prevent egress of foodstuff through the interrupted area 27.

In order to open pouch 10 using the opening means, pouch 10 is grasped at, for example, location 30 as shown in FIG. 1 with one hand and on the opposite side of perforation 26 with the other hand and then pulled apart to cause pouch 10 to tear open along longitudinal perforation 26 through interrupted sealing area 27. Tooth gear cut 25 facilitates the beginning of the tearing action along perforation 26. Tooth gear cut 25 also allows pouch 10 to be opened without having to tear through top seal 24. In this manner, pouch 10 is easily opened for dispensing of the contents.

Seals 14, 20, 23 and 24 may be made by any conventional means known to persons of skill in the art such as a heat sealing means. Interruptions in one or more of seals 23 and/or 24 may be formed by interrupting the sealing operation briefly to create an interruption in the seal of preferably about four millimeters in length.

Figure 2:
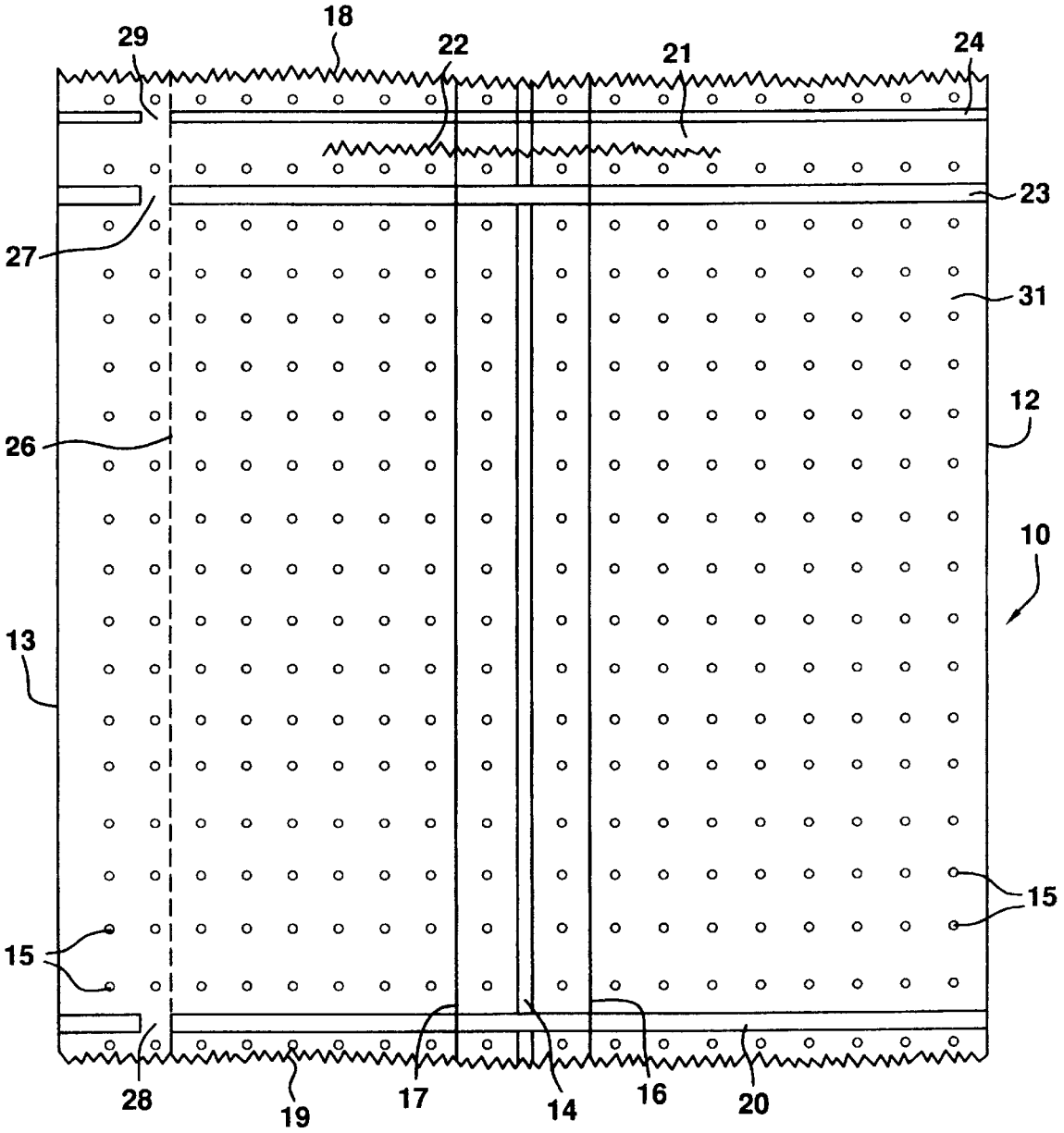
FIG. 2 is a plan view of a second embodiment of the boil-in-a-bag pouch of the present invention.

Referring to FIG. 2, there is shown a second embodiment of the pouch 10 of the present invention which is provided with a different opening means than the embodiment of FIG. 1 In particular, the opening means of this embodiment also includes a line of weakness which is formed by a longitudinal perforation 26 located a short distance from fold 13 which forms the side edge of pouch 10. Also, in this embodiment, lateral middle seal 23 is interrupted at 27 so that perforation 26 passes through interruption 27 of lateral middle seal 23.

In addition, this second embodiment is characterized by having interruptions 28, 29 in lateral bottom seal 20 and lateral top seal 24, respectively. Interruptions 28, 29 are aligned with interruption 27 in lateral middle seal 23 such that the line of weakness formed by perforation 26 passes through all three interruptions 27–29. Of course, it is within the scope of this embodiment to only provide an interruption 28 or 29 in one of lateral bottom seal 20 or lateral top seal 24 in addition to the interruption in lateral middle seal 23.

Interruptions 27–29 in lateral seals 20 and 23–24 allow the pouch 10 to be opened by tearing it along perforation 26 without having to tear through one or more of the lateral seals 20 and 23–24. Since such lateral seals tend to resist tearing, the provision of interruptions 27–29 facilitates the tearing of perforation 26 thereby simplifying the consumer's task of opening pouch 10.

Figure 3:
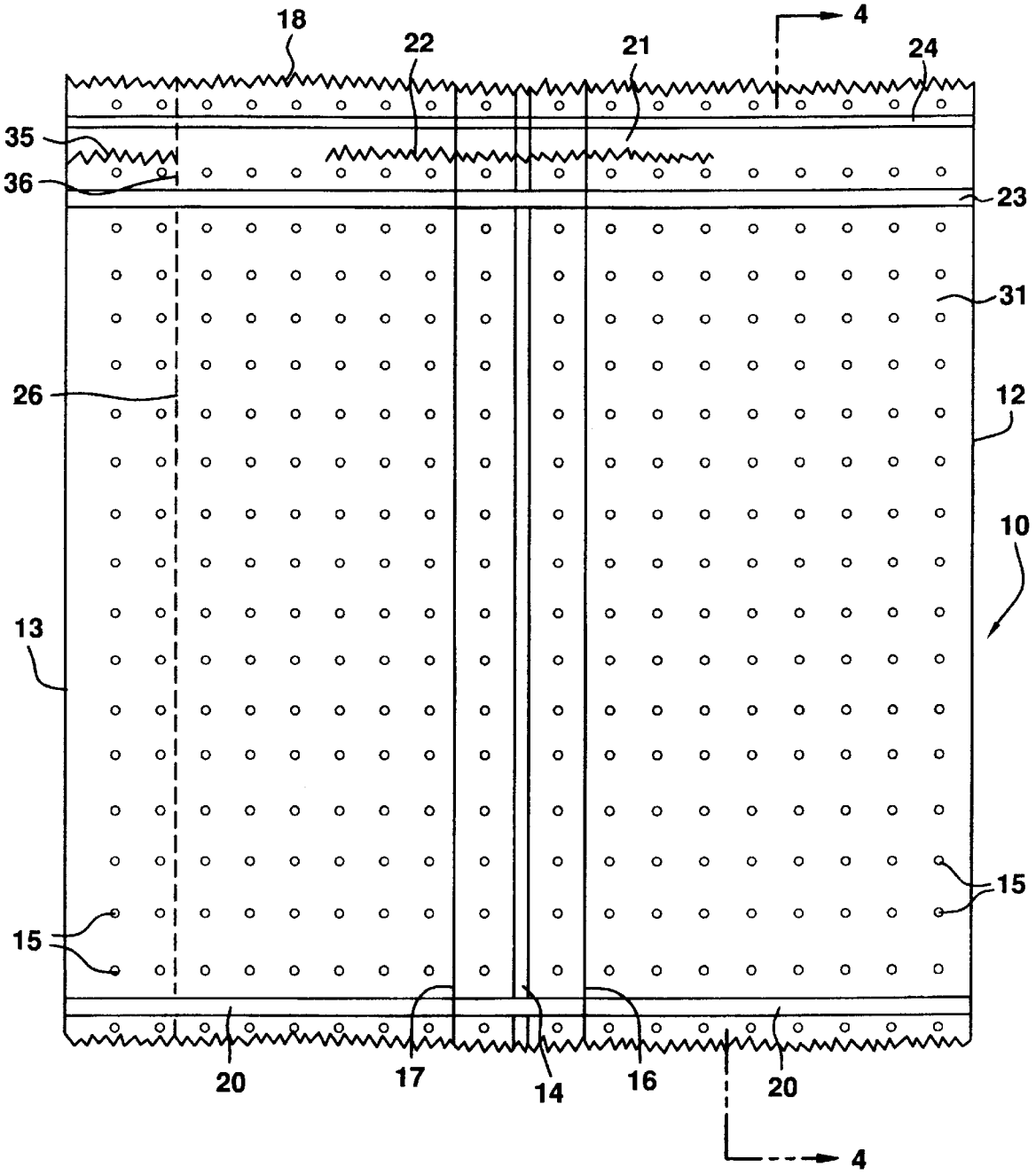
FIG. 3 is a plan view of a third embodiment of the boil-in-a-bag pouch of the present invention.

Referring now to FIG. 3 there is shown a third embodiment of a pouch 10 in accordance with the present invention. This embodiment is also characterized by a unique means for opening pouch 10 in order to dispense and serve the contents thereof.

The opening means of the embodiment of FIG. 3 includes a line of weakness formed by a longitudinal perforation 26 located a short distance from fold 13 which forms the edge of pouch 10. The opening means of this embodiment also includes a second lateral cut 35 which begins at fold 13 and terminates at perforation 26. Second lateral cut 35 is preferably made by the same means as first lateral cut 22 which forms handle 21 and in the most preferred embodiment second lateral cut 35 is aligned with first lateral cut 22 in order to simplify the manufacture of pouch 10. Second lateral cut 35 facilitates the opening of pouch 10 by permitting the consumer to begin tearing along perforation 26 without having to tear through lateral top seal 24.

Second lateral cut 35 may also include a short longitudinal cut 36 which is parallel to, or coextensive with, perforation 26. The short longitudinal cut 36 also facilitates tearing along perforation 26 since cut 36 helps to start the tearing action in the proper direction along perforation 26.

The embodiment of FIG. 3 may optionally also include interruptions (not shown) in lateral middle seal 23 and lateral bottom seal 20 as in the previous embodiments in order to facilitate tearing along perforation 26 through lateral middle seal 23 and lateral bottom seal 20.

Figure 4:
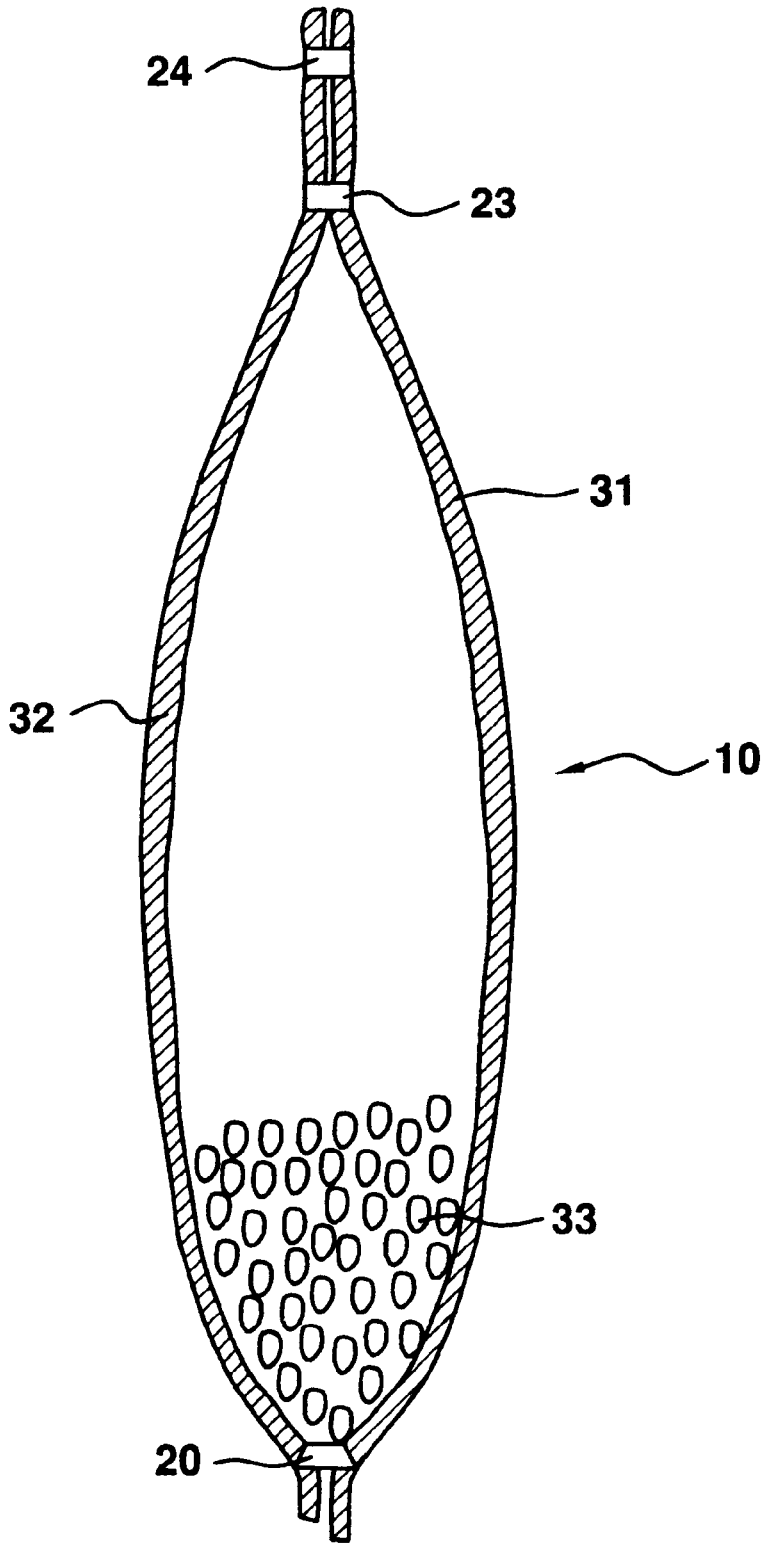
FIG. 4 is a cross-sectional view of a boil-in-a-bag pouch of the present invention taken along lines IV—IV of FIG. 3.

Referring now to FIGS. 4, there is shown a cross-sectional view of a pouch 10 in accordance with the present invention along lines IV—IV of FIG. 3. This figure shows layers 31, 32 sealed by lateral bottom seal 20, lateral middle seal 23 and lateral top seal 24 to form pouch 10 Also shown are the contents 33 of pouch 10 which in this case is rice.

Figure 5:
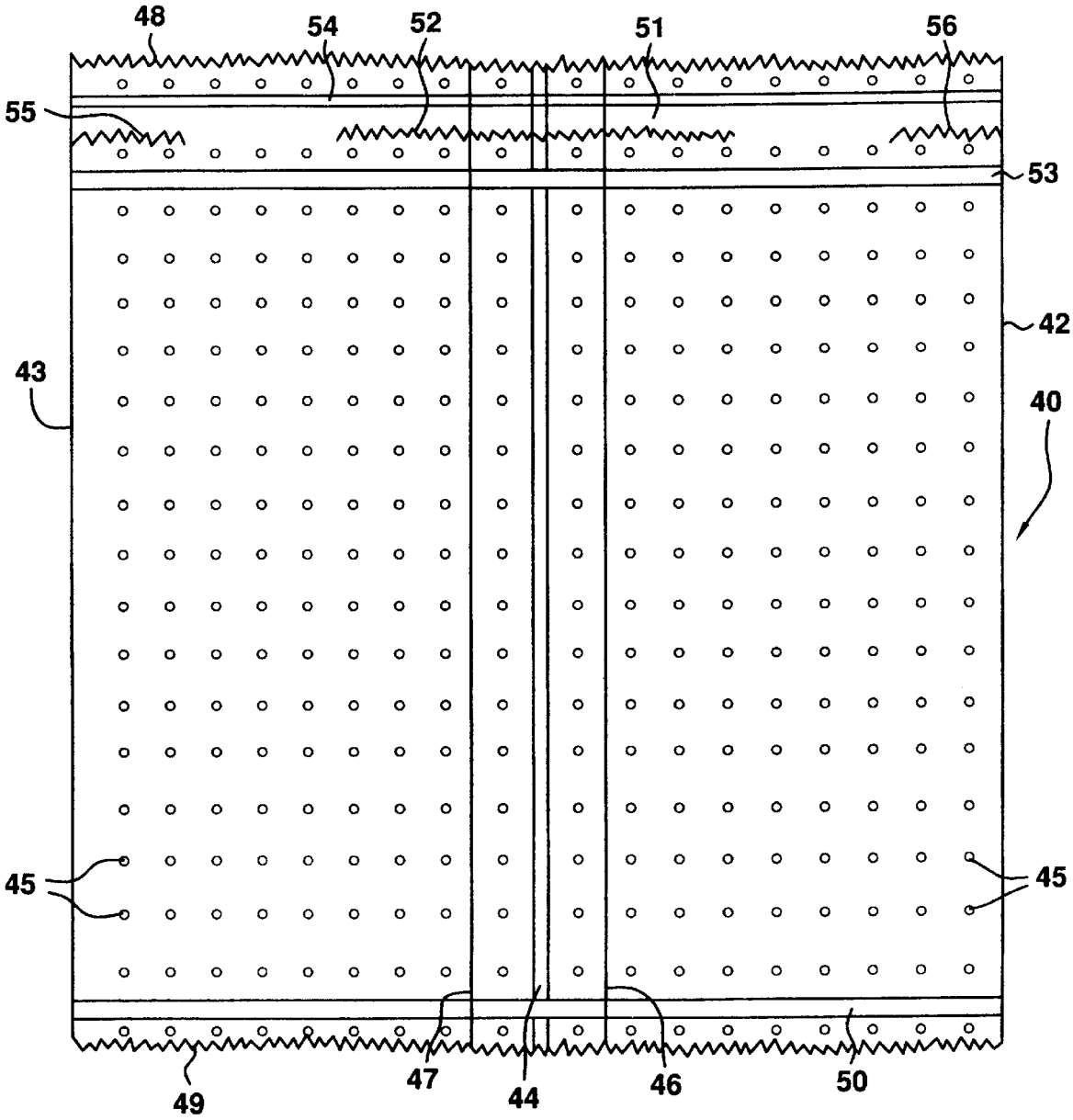
FIG. 5 is a plan view of a prior boil-in-a-bag pouch.

Referring to FIG. 5, there is shown a prior boil-in-a-bag pouch 40 which is provided with a handle 51. The prior pouch is also formed from a plastic film having small openings 45 over substantially the entire surface thereof and which is folded at 42, 43 to form the longitudinal edges of pouch 40. The first edge 46 of the plastic film is overlapped with the second edge 47 and sealed by a longitudinal seal 44 to join the edges. The top and bottom of the pouch 40 also include tooth gear cut patterns 48, 49 respectively which result from cutting a sheet of the plastic film from a continuous roll of said film.

Prior pouch 40 is formed by providing a lateral bottom seal 50 along the bottom edge of the pouch 40 and then filled with a foodstuff using, for example, a form-fill seal machine. Once pouch 40 is filled with a foodstuff, lateral top seal 54 and lateral middle seal 53 are applied. Prior art pouch 40 also includes a handle 51 which is formed by a first lateral cut 52 which penetrates both layers of the plastic film and is located between lateral middle seal 53 and lateral top seal 54.

Prior pouch 40 is also provided with two additional lateral cuts 55, 56 which extend from folds 43, 44 respectively and are also located between lateral middle seal 53 and lateral top seal 54. Lateral cuts 55, 56 are provided to facilitate the tearing open of pouch 40 by allowing the consumer to begin tearing the pouch 10 open at the inner end of either of lateral cuts 55, 56 rather than to try and tear the pouch open by tearing through one of the folds 42, 43.

Prior pouch 40 suffers from the disadvantage that the consumer, in order to open pouch 40, must tear through at least one of the lateral seals 50 and 53–54. This makes opening the pouch 40 difficult since such seals tend to resist tearing, particularly when the pouch 40 is still warm from being immersed in boiling water.

The foregoing description of the preferred embodiments of the invention has been presented for the purposes of illustration and description only and is not to be construed as limiting the invention in any way. The scope of the invention is to be determined from the claims appended hereto.

I claim:

1. A boil-in-a-bag food pouch which comprises two layers of plastic film sealed together by at least three lateral seals to form a pouch having a top edge, a bottom edge and two side edges, a first and second of said seals being located along the top and bottom edges, respectively, of said plastic film forming a top seal and a bottom seal respectively, said pouch containing a foodstuff therein, said plastic film containing a plurality of small openings disposed over a substantial portion of the surface of the film, the small openings being sufficiently large and numerous to permit water to freely enter and leave the pouch when said pouch, wit said foodstuff contained therein, is immersed in water, and the small openings also being sufficiently small to prevent egress of the foodstuff from said pouch;

a handle formed from a combination of the third of said lateral seals between said layers of film which third lateral seal is located below the top seal which forms the top of said pouch but in an upper portion of said pouch, and a first lateral cut located between said top seal and said third lateral seal and having ends which are spaced from the adjacent side edges of said pouch, and wherein the first lateral cut penetrates both layers of said film to provide a means for grasping and lifting said pouch;

an opening means comprising a line of weakness formed by a longitudinal perforation which penetrates both layers of film and which runs at least a substantial portion of the entire length from the top to the bottom of said pouch and which is located between one end of said first lateral cut and one of the said adjacent side edges of said pouch;

said opening means further comprising an interrupted sealing area in the third lateral seal forming an unsealed area in the line of the third lateral seal, said line of weakness placed such that it passes through the interruption in said third lateral seal;

said opening means further comprising a second lateral cut through both layers of film and located between said top seal and said third lateral seal and extending from the side edge of said pouch at least to said line of weakness; and wherein the width of said interruption in said lateral seal is greater than the width of said line of weakness but sufficiently small to prevent egress of the foodstuff from the pouch through said interruption.

2. A food pouch as claimed in claim 1 wherein said first and second lateral cuts are aligned with one another.

3. A food pouch as claimed in claim 2 wherein said first and second lateral cuts are tooth gear cuts.

4. A food pouch as claimed in claim 3 wherein said pouch is formed from a unitary sheet of plastic film folded over upon itself to form an overlapping zone and joined by a longitudinal, seal located in said overlapping zone and extending from the top to the bottom of the pouch.

5. A food pouch as claimed in claim 1 wherein said opening means further comprises an interruption in said top seal aligned with the interruption in said third lateral seal such that the line of weakness passes through both the interruption in the third lateral seal and the interruption in the top seal.

6. A food pouch as claimed in claim 1 wherein said opening means further comprises an interruption in the bottom seal aligned with the interruption in the third lateral seal such that the line of weakness passes through both the interruptions in the bottom seal and the third lateral seal.

7. A food pouch as claimed in claim 6 wherein said interruptions in said bottom and third lateral seals are sufficiently small to prevent egress of the foodstuff from the pouch through said interruptions.

* * * * *